US005106329A

United States Patent [19]

Maeshima et al.

[11] Patent Number: 5,106,329

[45] Date of Patent: Apr. 21, 1992

[54] SOCKET CONTACT

[75] Inventors: Toshiro Maeshima; Seiji Kozono; Toshiharu Kudo; Mitsuhiko Totsuka; Kazuaki Sakurai, all of Shizuoka, Japan

[73] Assignee: Yazaki Corporation, Tokyo, Japan

[21] Appl. No.: 679,480

[22] Filed: Apr. 2, 1991

[30] Foreign Application Priority Data

May 16, 1990 [JP] Japan ..... 2-50271[U]

[51] Int. Cl.[5] ..... H01R 13/00

[52] U.S. Cl. ..... 439/851; 439/856

[58] Field of Search ..... 439/845, 849–852, 439/856, 857, 861, 862

[56] References Cited

U.S. PATENT DOCUMENTS

| | | | |
|---|---|---|---|
| 2,743,128 | 4/1956 | Martines | 439/851 |
| 3,192,498 | 6/1965 | Ruehlemann . | |
| 3,406,376 | 10/1968 | Varrin . | |
| 4,345,373 | 8/1982 | Lacaze, Jr. . | |
| 4,919,628 | 4/1990 | Mobley et al. | 439/852 |

FOREIGN PATENT DOCUMENTS

| | | | |
|---|---|---|---|
| 674830 | 4/1939 | Fed. Rep. of Germany | 439/852 |
| 1465104 | 1/1969 | Fed. Rep. of Germany | 439/851 |
| 6311751 | 11/1975 | Japan . | |
| 63102182 | 10/1982 | Japan . | |

*Primary Examiner*—Joseph H. McGlynn

*Attorney, Agent, or Firm*—Sughrue, Mion, Zinn Macpeak & Seas

[57] ABSTRACT

A socket contact is constituted by a general tubular-shaped body and a pair of opposed resilient members formed by splitting the front portion of the general tubular body with a pair of slits. One of the opposed resilient members has an inner surface having a pair of contacting portions at the predetermined peripheral intervals. The other opposed resilient member has an inner surface having a contact portion in confronting relation with a peripheral center of the pair of contacting portions of the one of the opposed resilient members. As a result, it is possible to clamp a male contact to be inserted stably between the opposed resilient members and then to keep a posture of the male contact with high contact pressure against the male contact.

5 Claims, 2 Drawing Sheets

SOCKET CONTACT

BACKGROUND OF THE INVENTION

This invention relates to a female or socket contact which is used as an element connecting a wire harness or the like for a vehicle.

FIG. 5 shows a conventional female or socket contact a which is constituted by a female electrical contact portion b and a wire connecting portion c. The female electrical contact portion b is formed with a general tubular body $b_1$, in which two arch-shaped elastic contact portions b: are providing a slit $b_2$ therein so as to split a front portion of the tubular body $b_1$ into two pieces. A receiving chamber $b_4$ for receiving a male contact (terminal pin) d as shown in FIG. 6(*a*) is formed between arch-shaped ends $b_1$, of the arch-shaped contact portions.

As shown in FIG. 6(*a*), two pieces of the arch-shaped contact portions $b_2$ in the conventional socket contact are disposed opposite each other such that the male contact d comes into contact with both peripheral ends $b_5$, $b_5$ of the arch-shaped end $b_3'$, The male contact d is clamped by four pieces of the peripheral ends $b_5$ of the arch-shaped end $b_1'$, so that it is possible to support the male contact d stably at a connecting position. On the other hand, a contacting force applied at a piece of the arch-shaped elastic contact portion $b_3$ is divided in half because of transmission of the contacting force through two pieces of the peripheral ends $b_5$, causing a problem in that it becomes impossible to obtain a strong contact pressure In addition, as shown in FIG. 6(*b*), a conventional socket contact is constructed so that peripheral center portions $b_6$, $b_6$ of the arch-shaped ends $b_3''$, come into contact with the male contact d. As a result, a contacting force at a piece of the arch-shaped elastic contact portion $b_3$ is concentrated at the peripheral center portions $b_6$, so that it is possible to obtain a strong contact pressure. On the other hand, this structure also causes a problem in that it becomes impossible to support the male contact d stably at a connecting position.

SUMMARY OF THE INVENTION

In view of the above problems, it is one object of this invention to improve reliability of electrical connection of a female contact so that a connecting posture of a male contact to be inserted into the female contact is maintained stable by clamping the male contact with a pair of opposed resilient members of the female contact together with a strong contacting pressure.

The inventive socket contact is constituted by a general tubular-shaped body and a pair of opposed resilient members formed by splitting a front portion of the general tubular-shaped body with a slit, in which one of the opposed resilient members has an inner surface having a plurality of contacting portions at a predetermined peripheral interval, and the other of the opposed resilient members has a contact portion in confronting relation with a peripheral center of the plurality of contacting portions of the first of the opposed resilient members.

BRIEF DESCRIPTION OF THE DRAWINGS

FIG. 4(*b*) is an explanatory view of an operating condition of the third embodiment of the present invention;

FIG. 4(*c*) is an explanatory view of an operating condition of the fourth embodiment of the present invention;

FIG. 6(*b*) is an explanatory view of an operating condition of the other example of the conventional socket contact.

DETAILED DESCRIPTION OF THE PREFERRED EMBODIMENTS

Figure 1:
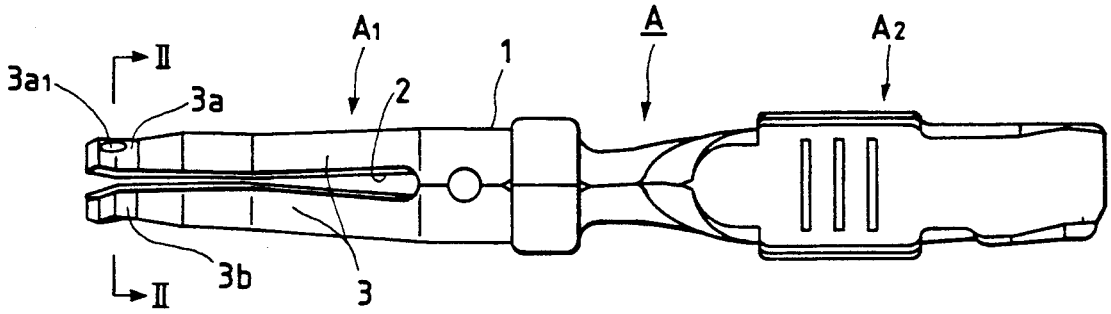
FIG. 1 is a plan view of a socket contact according to a first embodiment of the present invention.
Figure 2:
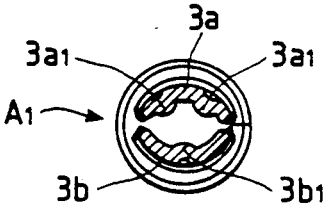
FIG. 2 is a cross-sectional view taken along the line II—II in FIG. 1.

FIGS. 1 and 2 show a first embodiment of a socket contact A of the present invention, which is formed by punching and bending a metal plate, including an electrical female contact portion $A_1$ and a wire connecting portion $A_2$. The electrical female contact portion $A_1$ is constituted by a generally tubular body 1 and a pair of opposed resilient contacting portions 3, 3 which are formed by providing a slit 2 at a front portion of the tubular body 1.

Each of the resilient contacting portions 3 has arch-shaped contacting portions 3*a*, 3*b* at both free ends thereof. A pair of indent-shaped contacting portions $3a_1$, $3a_1$ protrude inwardly from the inner surface of the arch-shaped contacting portion 3*a* at a predetermined peripheral interval. An indent-shaped contacting portion $3b_1$ protrudes inwardly from the inner surface of the arch-shaped contacting portion 3*b* so that the portion $3b_1$ is in confronting relation with a peripheral center between the indent-shaped contacting portions $3a_1$, $3a_1$.

Figure 3:
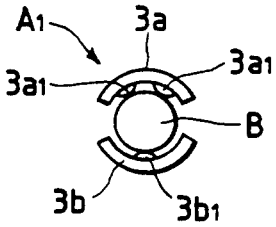
FIG. 3 is an explanatory view of an operating condition of the first embodiment of the present invention.

When a pin-shaped male contact B is inserted between the arch-shaped contacting portions 3*a*, 3*b* of the pair of resilient contacting portions 3, 3, the portions $3a_1$, $3a_1$ and $3b_1$ respectively contact the male contact B. At this time, the portions $3a_1$ and $3a_1$ act to keep stable a posture of the male contact B, and the portion $3b_1$ acts as a member for increasing a contact pressure therebetween, as shown in FIG. 3.

Although a pair of the indent-shaped contacting portions are used in the first embodiment of the present invention as members for stably keeping a posture of the male contact B, it is possible to modify the apparatus of the embodiment to use more than two contacting portions.

Figure 4A:
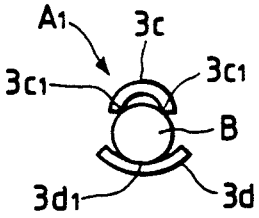
FIG. 4(*a*) is an explanatory view of an operating condition of the second embodiment of the present invention.
Figure 4B:
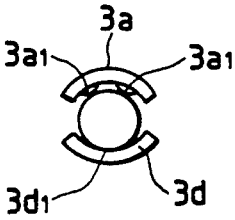
Figure 4C:
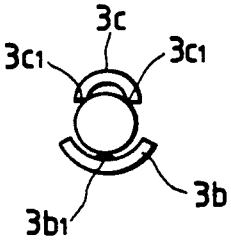
Figure 5:
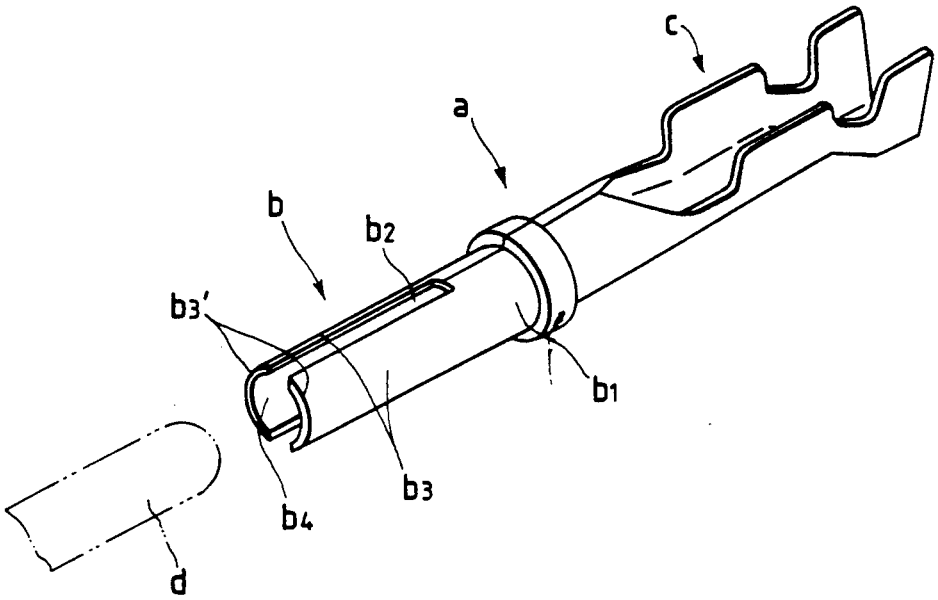
FIG. 5 is a plan view of an example of a conventional socket contact.
Figure 6A:
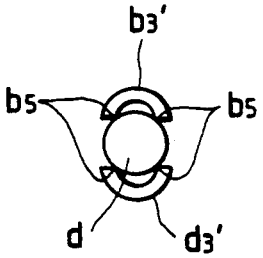
FIG. 6(*a*) is an explanatory view of an operating condition of the example of the conventional socket contact.
Figure 6B:
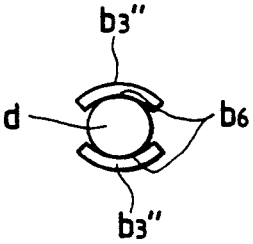

FIGS. 4(*a*)–4(*c*) show the other embodiments of the present invention in which the arch-shaped contacting portions 3*a*, 3*b* of the first embodiment are modified. FIG. 4(*a*) shows a second embodiment of the present invention in which an arch-shaped contacting portion 3*c* is formed with direct-contacting ends 3*c* and $3c_1$ instead of the indent-shaped contacting portions $3a_1$ and $3a_1$ of the first embodiment. An arch-shaped contacting portion 3*d* is formed with a direct-contacting center $3d_1$ instead of the indent-shaped contacting portions $3b_1$ of the first embodiment. FIG. 4(*b*) shows a third embodiment of the present invention in which a combination of the indent-shaped contacting portions $3a_1$ and $3a_1$ and the contacting end $3d_1$ is used in the arch-shaped contacting portions 3*a* and 3*d*. FIG. 4(*c*) shows a fourth embodiment of the present invention which uses a combination of the direct-contacting ends $3c_1$, $3c_1$ and the indent-shaped contacting portion $3b_1$ in the arch-shaped contacting portions 3*c* and 3*b*.

As described above, according to the present invention, a socket contact is constituted by a general tubular body and a pair of opposed resilient members formed by splitting the front portion of the general tubular body with a pair of slits. An inner surface of one of the opposed resilient member has a contact portion in confronting relation with a peripheral center of the plurality of contacting portions of the first opposed resilient members. As a result, it is possible to clamp stably the male contact to be inserted between the opposed resilient members and to keep a posture of the male contact with high contact pressure against the male contact.

While the invention has been described in detail above with reference to preferred embodiments, various modifications within the scope and spirit of the invention will be apparent to people of working skill in this technological field. Thus, the invention should be considered as limited only by the scope of the appended claims.

What is claimed is:

1. A socket contact comprising:

a tubular-shaped body;

a first resilient member protruding from a front portion of said tubular-shaped body in a cantilevered manner, said first resilient member having at least two contacting portions at a predetermined peripheral interval; and a second resilient member, distinct from said first resilient member, protruding from a front portion of said tubular-shaped body in a cantilevered manner so as to be opposed to said first resilient member, said second resilient member having a contact portion which is formed in confronting relation with a peripheral center of said two contacting portions of said first resilient member.

2. A socket contact as claimed in claim 1, wherein said contacting portions of said first resilient member comprise indentations protruding inwardly from said first resilient member.

3. A socket contact as claimed in claim 1, wherein said contacting portions of said first resilient member comprise ends of said first resilient member.

4. A socket contact as claimed in claim 1, wherein said contact portion of said second resilient member comprises an inner surface of said second resilient member.

5. A socket contact as claimed in claim 1, wherein said contact portion of said second resilient member comprises an indentation protruding inwardly from said second resilient member.

* * * * *